US007232337B1

(12) United States Patent
Pepe et al.

(10) Patent No.: US 7,232,337 B1
(45) Date of Patent: Jun. 19, 2007

(54) CONNECTOR RECEPTACLE ASSEMBLY

(75) Inventors: Paul J. Pepe, Clemmons, NC (US); James E. Crompton, Terrell, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/374,401

(22) Filed: Mar. 13, 2006

(51) Int. Cl.
*H01R 13/73* (2006.01)

(52) U.S. Cl. ..... 439/557; 439/549

(58) Field of Classification Search ..... 439/557, 439/536, 538, 353, 954, 676, 549; 174/66
See application file for complete search history.

(56) References Cited

U.S. PATENT DOCUMENTS 5,041,018 A * 8/1991 Arnett ..... 439/536
5,096,439 A 3/1992 Arnett
6,334,792 B1 * 1/2002 Schmidt et al. ..... 439/676

* cited by examiner

*Primary Examiner*—Tho D. Ta
*Assistant Examiner*—Vanessa Girardi

(57) ABSTRACT

A connector receptacle assembly for facilitating electrical connections is provided. The receptacle assembly includes a housing having a mating end for receiving a plug assembly; and at least one flexible latch member disposed on and projecting from an outer surface of the housing. Each latch member is defined by a longitudinally extending slot formed in the housing and extending along a side edge of the latch member and a transversely extending slot formed in the housing and extends along a rear edge of the latch member. In one embodiment, each latch member is pivotable about a pivot axis extending between a distal end of the longitudinally extending slot and a distal end of the transversely extending slot.

20 Claims, 5 Drawing Sheets

CONNECTOR RECEPTACLE ASSEMBLY

BACKGROUND

1. Technical Field

The present disclosure relates generally to a connector receptacle assembly and, more particularly, to an electrical connector receptacle housing assembly having flexible latch members.

2. Description of Related Art

Electrical connector receptacle assemblies are commonly used for interconnecting a plurality of wires, such as, for example, a modular jack assembly type. This type of electrical connector assembly typically includes a housing of dielectric material having an opening or plug receiving cavity in its front or mating end. The electrical receptacle may be mounted in a device, panel or wall for enabling a plug assembly, such as a modular plug assembly, to be received within the plug receiving cavity. In many current applications, the electrical connector receptacle assembly is mounted to a wall using a cover plate which includes an opening for access to the plug receiving cavity.

One method of mounting the receptacle assembly to a wall or cover plate is shown in U.S. Pat. No. 5,041,018 which describes an electrical connector receptacle assembly of the modular jack assembly type. The receptacle assembly includes a pair of flexible members or latches mounted on an exterior surface of the housing. During mounting of the receptacle assembly to the cover plate, the flexible members are deflected into the cavity by squeezing, depressing or otherwise manipulating for mounting the electrical connector receptacle assembly to the cover plate. Similar steps in reverse are generally followed for releasing the electrical connector receptacle assembly from the cover plate and from the surface of the wall, i.e. the flexible members are squeezed for removing the receptacle assembly from the cover plate.

As shown by U.S. Pat. No. 5,041,018, the flexible members are mounted on the surface of the housing as cantilever structures. That is, one end of each flexible member is attached to the housing while a substantial portion of the flexible member hangs freely. Thus, the flexible members act as a lever. Cantilever deflections however, permit the buildup of residual stress about the fixed end of the flexible members, effectively creating inelastic deformations. In addition, cantilever deflections may also exhibit oscillatory behavior resulting from temperature fluctuations due to mechanical stress. The inelastic deformation and mechanical stresses resulting from the cantilever deflections may eventually lead to mechanical failure, such as, for example, permanent deformation, and breaking of the flexible member, thus requiring the installation of a new communication outlet.

Accordingly, a need exists for a new and improved connector receptacle assembly having flexible members or latches which are less likely to be permanently deformed or broken when bent for engaging (mounting) or disengaging the connector receptacle assembly.

SUMMARY

The present disclosure is directed to a new and improved connector receptacle assembly for interconnecting a plurality of wires, such as in telephonic and data communication systems. The present disclosure for exemplary purposes describes a particular connector receptacle assembly, i.e., a modular jack assembly. However, it is understood that the teachings of the present disclosure can be applied to any type of connector receptacle assembly, such as connector receptacle assemblies for interconnecting optical fibers.

The present disclosure provides a connector receptacle assembly which includes a housing having a mating end for connecting to a plug assembly; and at least one flexible latch member disposed on and projecting from an outer surface of the housing, wherein each latch member includes at least two surfaces fixedly supported to the outer surface of the housing. Each latch member is defined by a longitudinally extending slot formed in the housing and extending along a side edge of the latch member and a transversely extending slot formed in the housing and extending along a rear edge of the latch member.

The present disclosure also provides connector receptacle housing defining a cavity for receiving a plug assembly therein. The connector receptacle housing includes at least one latch member disposed on a first outer surface of the housing. The at least one latch member includes a rear surface; a forward angled surface extending away from a front surface of the housing; and a pair of orthogonally oriented slots formed in the first outer surface of the housing. Each slot is located along a respective side of the latch member. The latch member is deflectable into the cavity of the housing. Additionally, the at least one latch member is deflectable between a first un-biased position to a second biased position. In the second biased position, the at least one latch member is deflected towards the cavity of the housing.

The present disclosure also provides a modular jack assembly including a housing defining a cavity for receiving a modular plug assembly therein; a plurality of wires within the cavity for providing electrical communication with the modular plug assembly received therein; at least one latch member supported on and projecting from an outer surface of the housing; and a pair of orthogonally extending slots formed in the outer surface of the housing. The pair of orthogonally extending slots are located adjacent the at least one latch member. A pivot axis for the at least one latch member is defined between distal ends of the pair of orthogonally extending slots.

The at least one latch member is deflectable from a first un-biased position to a second biased position. Further, the at least one latch member is adapted for pivotable movement about the pivot axis when deflected between the first un-biased position to the second biased position.

Other features of the presently disclosed connector receptacle assembly will become apparent from the following detailed description taken in conjunction with the accompanying drawings, which illustrate, by way of example, the presently disclosed connector receptacle assembly.

DETAILED DESCRIPTION

Figure 1:
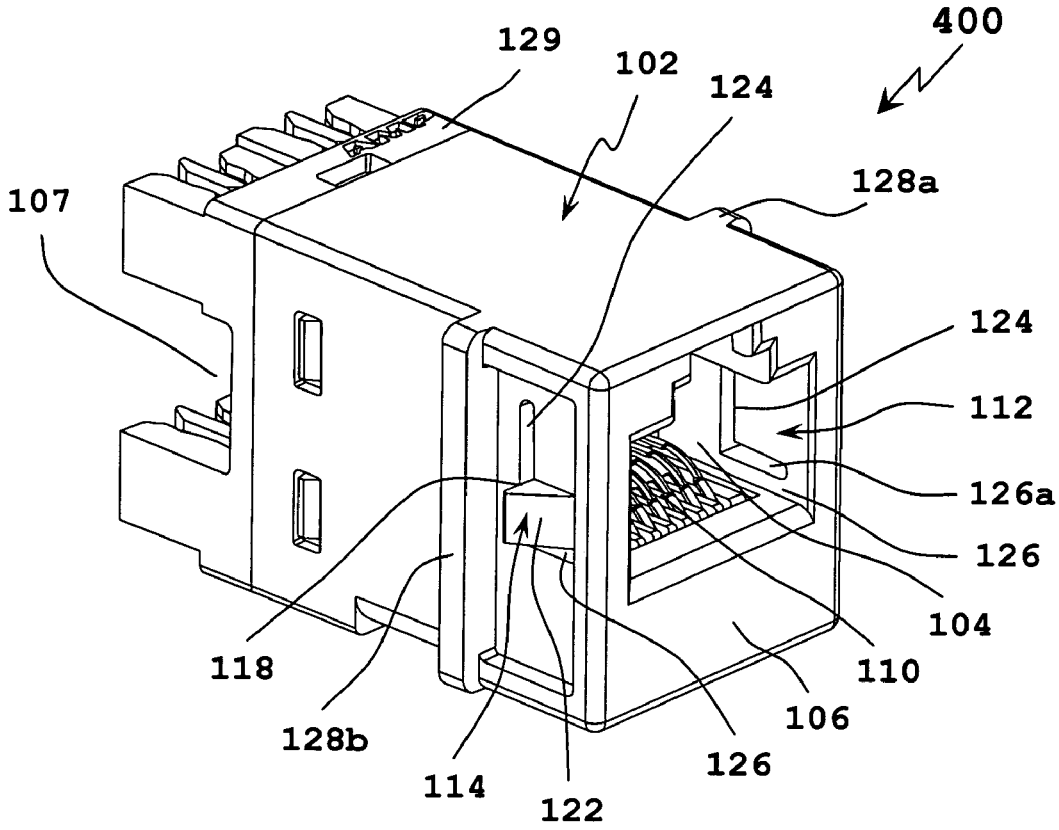
FIG. 1 is a top, front perspective view of connector receptacle assembly in accordance with the present disclosure.

Referring now to the drawing figures, wherein like references numerals identify identical or corresponding elements, an embodiment of the presently disclosed electrical connector receptacle assembly will now be described in detail. In the following description, terms such as "above", "below", "forward", "rearward", etc. refer to the orientation of the figures or the direction of components and are simply used for convenience of description.

In the following detailed description, an electrical connector receptacle assembly and mounting of the connector receptacle assembly is disclosed. A modular jack assembly is disclosed, however, the detailed description is for illustration purposes only, since it is envisioned that the teachings herein in accordance with the present disclosure can be applied to other types of connector receptacle assemblies, including, for example, fiber optic connector assemblies.

With initial reference to FIG. 1, an embodiment of a modular jack assembly or electrical connector receptacle assembly, in accordance with the present disclosure, is illustrated and is designated generally as modular jack assembly 400. Modular jack assembly 400 as defined herein encompasses any connector receptacle or communication outlet which interconnects a plurality of wires for establishing electrical communication, data communication, etc. Moreover, it is envisioned that modular jack assembly 400, may be employed with a range of devices adapted for establishing connections, such as, for example, electrical connectors, data connectors, telephonic connectors, and the like. As described herein, modular jack assembly 400 mates to a modular plug assembly (see FIG. 7) for use with an eight contacts communication cable (or plug). However, it should be understood that the present disclosure may also be applied to other connectors which are terminable to different numbers of wires.

With reference to FIG. 1, modular jack assembly 400 includes a housing 102 which may be constructed from dielectric material, such as, for example, a polycarbonate (PC). The housing 102 defines a cavity 104 at a modular plug assembly receiving end 106 which is opposite a wire receiving end 107. The cavity 104 extends to an interior wall 108 of modular jack assembly 400. In particular, cavity 104 is configured and adapted for receiving, for example, a modular plug assembly 208 (see FIGS. 6 and 7) for making an electrical connection therebetween, as described in detail herein below.

As is conventional in the art, modular jack assembly 400 includes a plurality of contacts or conductors 110 (see FIG. 1) disposed within cavity 104 of housing 102 for electrically connecting with a plurality of wires of modular plug assembly 208. With reference to FIG. 1, modular jack housing 102 is configured to mate with an insulation displacement contact (IDC) terminal assembly 129 as known in the art.

With reference to FIG. 1 which illustrate modular jack assembly 400 and FIGS. 2–5 which illustrate housing 102, housing 102 includes a pair of flexible latch members 112 and 114 disposed on respective outer surfaces 102*a*, 102*b* of housing 102. Flexible latch members 112 and 114 may be molded as part of housing 102. Alternatively, flexible latch members 112 and 114 may be formed as separate elements and secured to housing 102 by suitable known techniques. It is noted that flexible latch members 112, 114 are identical in design and operation. Thus the discussion henceforth will be limited to flexible latch member 112.

Figure 2:
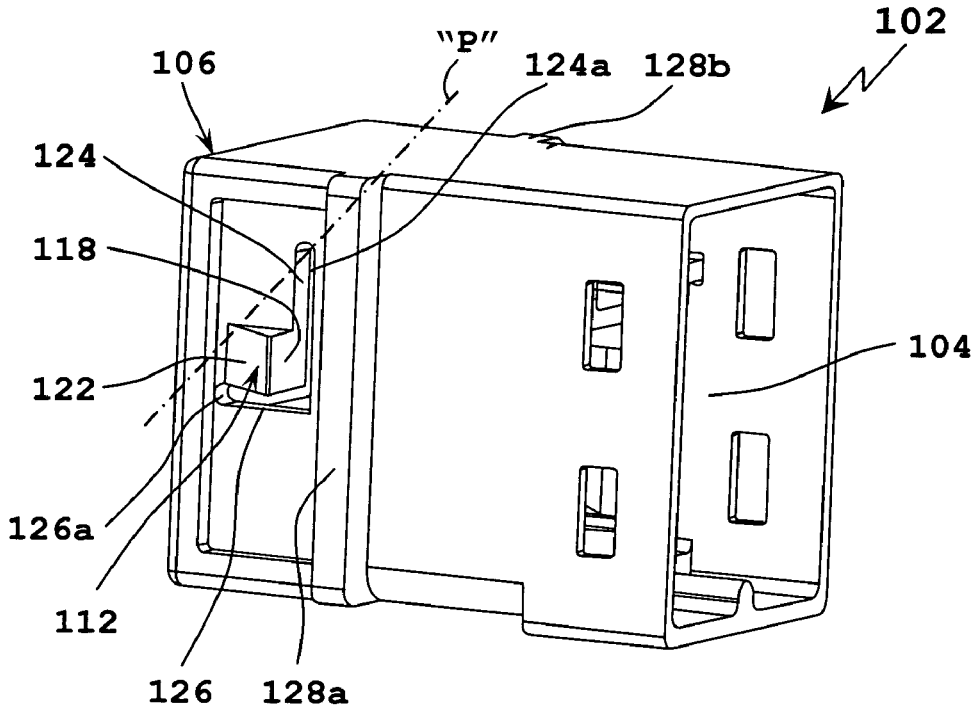
FIG. 2 is top, rear perspective view of a housing of the connector receptacle assembly shown by FIG. 1.
Figure 3:
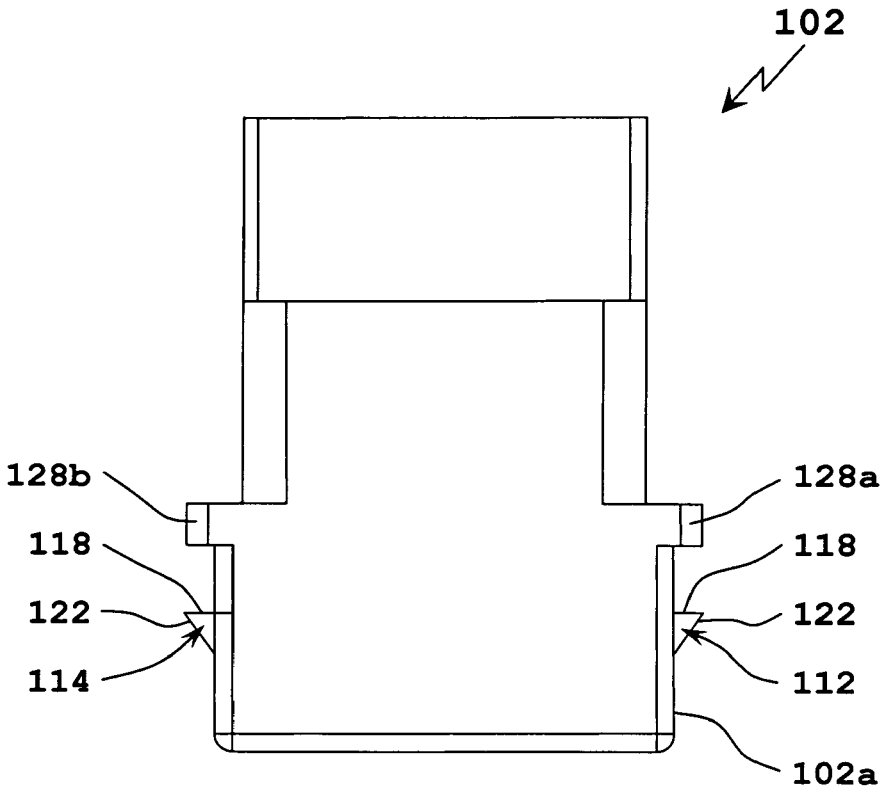
FIG. 3 is a top plan view of the housing of FIG. 2.
Figure 4:
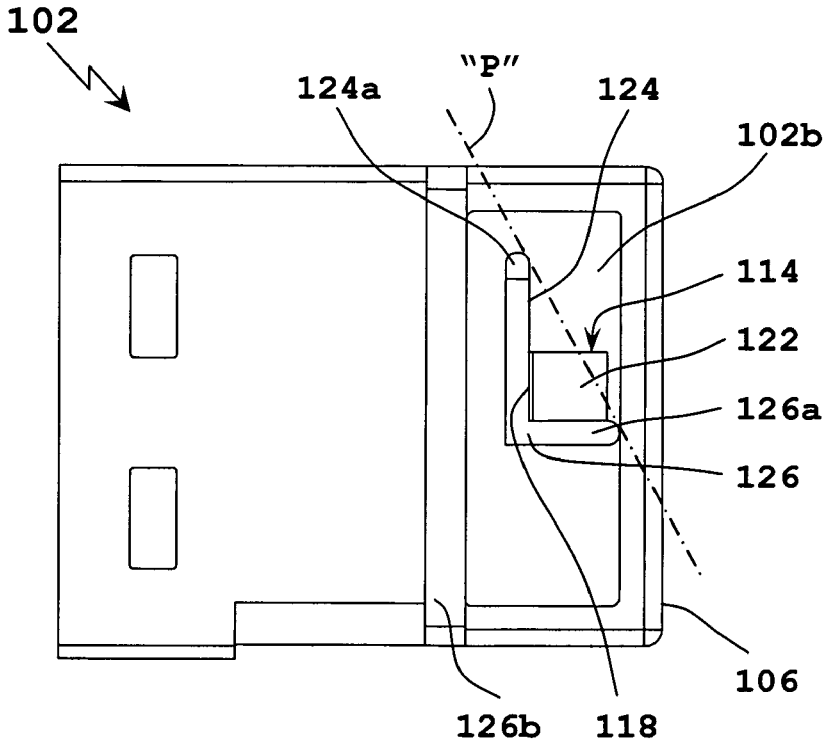
FIG. 4 is a side elevational view of the housing of FIGS. 2 and 3.
Figure 5:
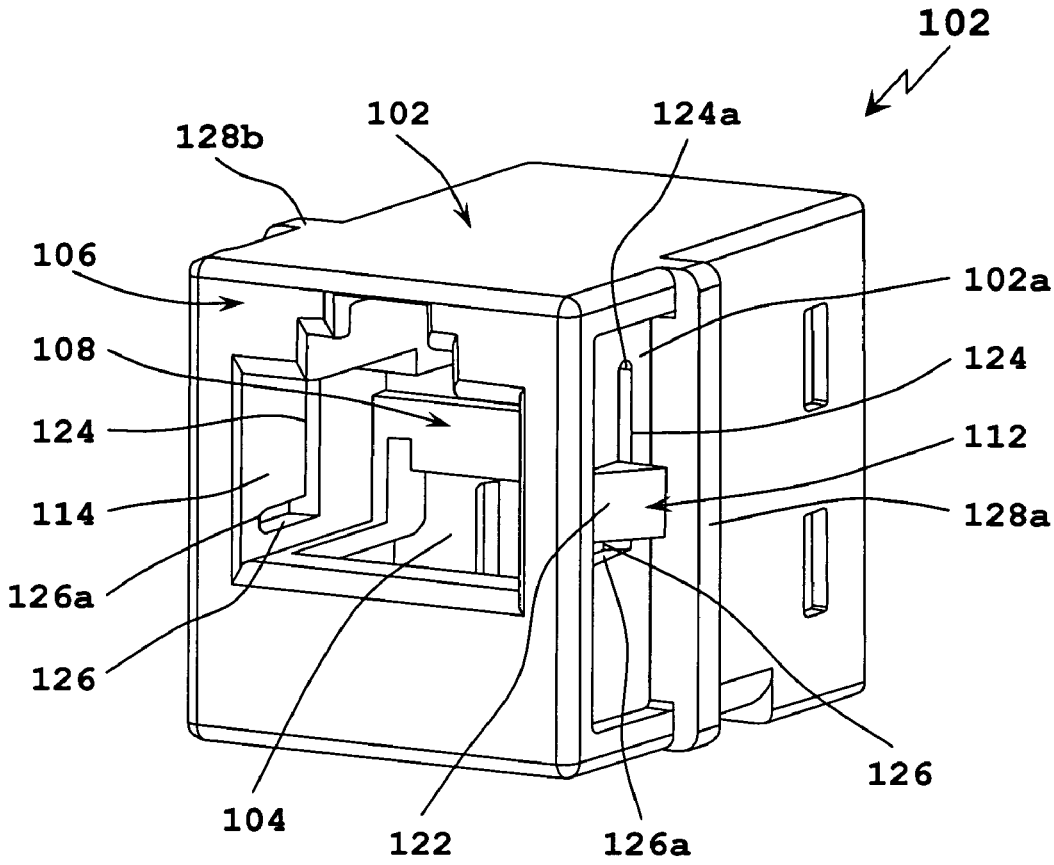
FIG. 5 is a top, front perspective view of a housing of FIGS. 2–4.

Flexible latch member 112 includes a rear surface 118 extending orthogonally from outer surface 102*a* of housing 102, and a ramped or angled front surface 122 extending between outer surface 102*a* of housing 102 and rear surface 118. Flexible latch member 112 is further defined by a first elongate slot 124 formed in outer surface 102*a* of housing 102 and extending in a direction parallel to a plane defined by rear surface 118 thereof; and a second elongate slot 126 formed in outer surface 102*a* of housing 102 and extending forwardly in a direction orthogonal to first elongate slot 124. First elongate slot 124 and second elongate slot 126 are integral with one another. As seen in FIGS. 2, 4 and 5, first elongate slot 124 is located at a base of rear surface 118 of latch member 112 (i.e., along a rear edge thereof) and second elongate slot 126 is located at a base of rear surface 118 and front surface 122 of latch member 112 (i.e. along a side edge thereof). First elongate slot 124 extends beyond flexible latch member 112 in a direction opposite to second elongate slot 126. First elongate slot 124 and second elongate slot 126 combine to form an L-shape slot.

Flexible latch members 112 and 114 are non-cantilever type latch members. Thus, each flexible latch members 112 and 114 are adapted for relative pivotal movement from a first relaxed or un-deflected position to a second biased or deflected position and back to the first relaxed or un-deflected position for latching modular jack assembly 400 into place, in a manner described in details hereinbelow. As illustrated by the figures, each flexible latch member 112 and 114 protrudes from a respective surface 102*a*, 102*b* of housing 102 when in the first relaxed or un-deflected position. When in the first relaxed or un-deflected position flexible latch members 112 and 114 secures modular jack assembly 400 in place following installation.

Each flexible latch member 112 and 114 deflects along a pivot axis "P" defined between a distal end 124*a* of first elongate slot 124 and a distal end 126*a* of second elongate slot 126, as illustrated in FIG. 4. Accordingly, when modular jack assembly 400 is being mounted into position, flexible latch members 112, 114 each deflect inwardly, about pivot axis "P" to snap fit engage over and/or beyond a mounting surface (e.g., cover plate 200 of FIGS. 6 and 7). Once flexible latch members 112, 114 have moved beyond the mounting surface, flexible latch members 112, 114 return to the first relaxed or un-biased position. Desirably, distal end 124*a* of first elongate slot 124 extends beyond flexible latch member 112, 114 in a direction opposite to second elongate slot 126.

With continued reference to FIGS. 1–5, modular jack assembly 400 includes stop members 128*a*, 128*b* projecting outwardly from respective surfaces 102*a*, 102*b* of housing 102. Stop members 128*a*, 128*b* limit the progression of modular jack assembly 400 through a portion of a wall surface or a cover plate, in a manner described in detail hereinbelow.

Figure 6:
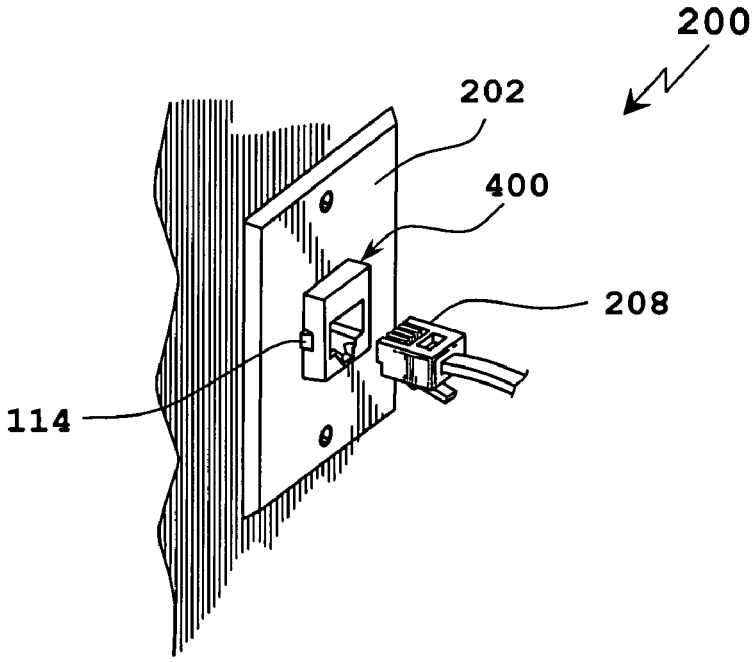
FIG. 6 illustrates the connector receptacle assembly of the present disclosure mounted to a cover plate.
Figure 7:
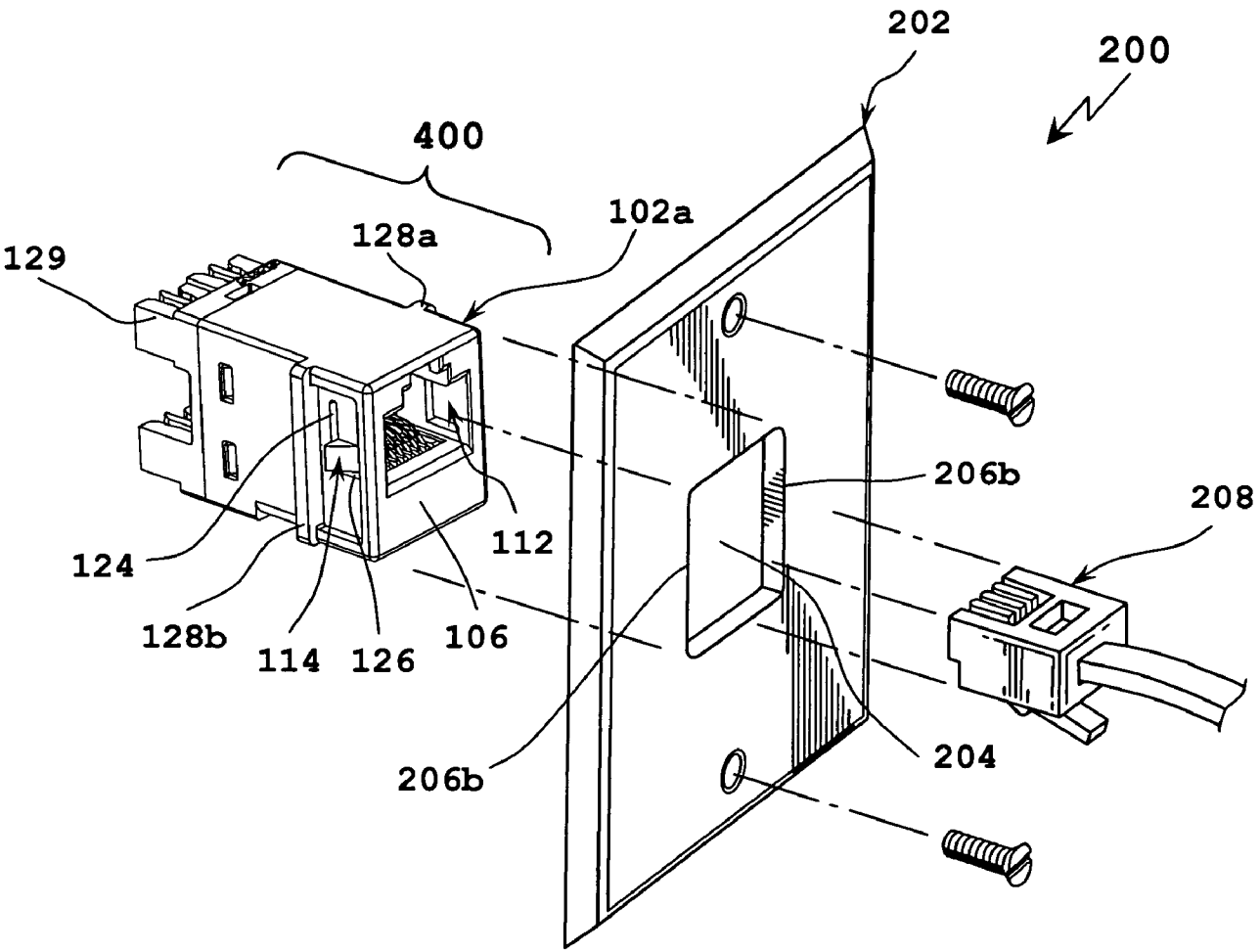
FIG. 7 is an exploded view showing the connector receptacle assembly of FIG. 5, a cover plate and a connector plug assembly.

With reference to FIGS. 6 and 7, the components of a communication outlet 200 will now be discussed in detail. Communication outlet 200 includes a cover plate 202 having a planar profile and defining an opening 204 therein for receiving modular jack assembly 400. Cover plate 202 opening 204 is bounded by edge portions 206*a* and 206*b*.

Edge portions 206*a* and 206*b* are configured to engage flexible latch members 112, 114 during mounting of the modular jack assembly 400 to the cover plate 202.

During installation, mating end 106 of modular jack assembly 400 is positioned and advanced through opening 204 of cover plate 202. As modular jack assembly 400 is advanced, flexible latch members 112 and 114 are deflected into cavity 104 of housing 102 and snapped around edge portions 206*a*, 206*b* of opening 204 of cover plate 202. Flexible latch members 112 and 114 are deflected into cavity 104 of housing 102 by a camming action taking place between edge portions 206*a*, 206*b* of opening 204 and angled front surfaces 122 of respective flexible latch members 112, 114. During deflection of flexible latch members 112 and 114 into cavity 104 of housing 102, flexible latch members 112 and 114 are deflected, along pivot axis "P", from the first relaxed position to the second biased position.

Stop members 128*a*, 128*b* operate to limit the advancement of modular jack assembly 400 through opening 204 of cover plate 202. Once mating end 106 of modular jack assembly 400 is fully advanced into opening 204 of cover 202, such that stop members 128*a*, 128*b* abut against cover 202, or flexible latch members 112, 114 have cleared edge portions 206*a*, 206*b* of opening 204, flexible latch members 112 and 114 return to the initial first relaxed position. Thus, cover plate 202 is and remains captured between stop members 128*a*, 128*b* and flexible latch members 112 and 114, as illustrated by FIG. 6. This holds the modular jack assembly 400 in the wall/cover plate 202. Therefore, according to the present disclosure, the flexible latch members 112 and 114 alone are not the entire mounting feature. Subsequently, plug 208 may be inserted and received by cavity 104 of housing 102 for making an electrical connection therebetween.

In order to remove modular jack assembly 400 from cover plate 202, flexible latch members 112, 114 are squeezed towards one another or pivoted, along pivot axis "P", into cavity 104 of housing 102 by an amount sufficient for front surfaces 118 to clear edge portions 206*a*, 206*b* of opening 204 of cover plate 202. Once front surfaces 118 of flexible latch members 112, 114 clear opening of cover plate 202, modular jack assembly 400 may be withdrawn or removed therefrom.

Figure 8:
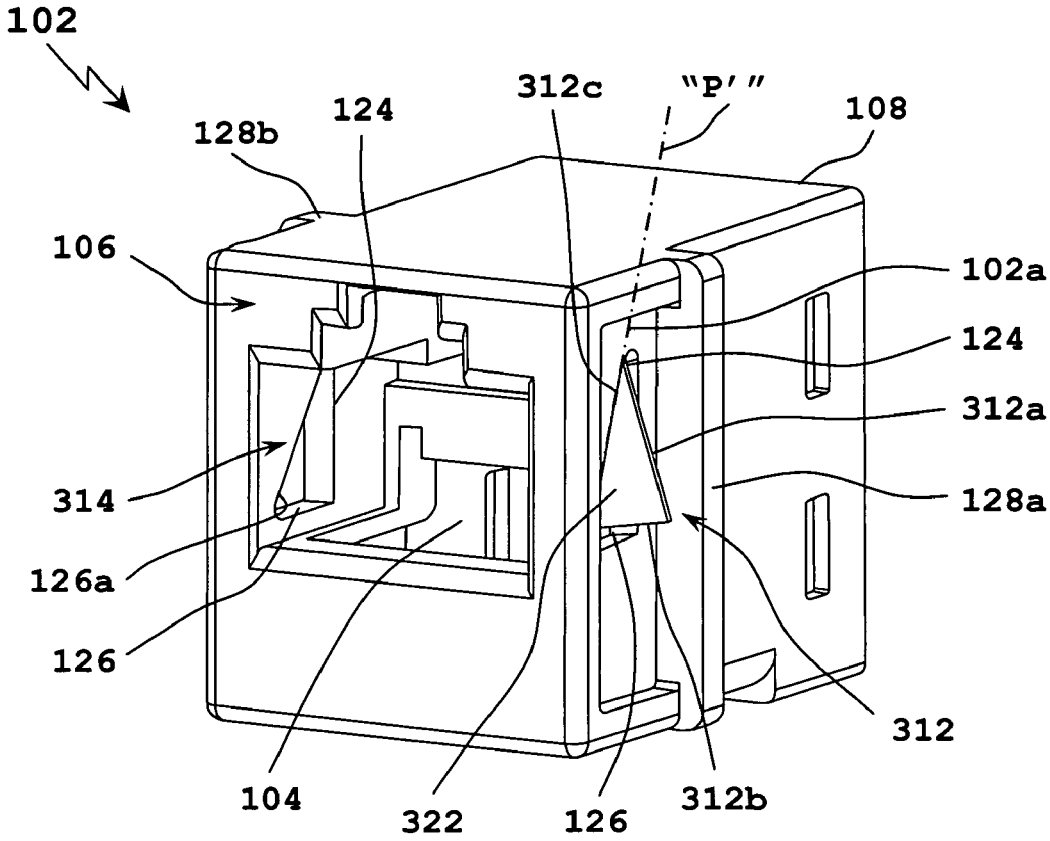
FIG. 8 is a top, front perspective view of a connector receptacle housing, according to another embodiment of the present disclosure.
Figure 9:
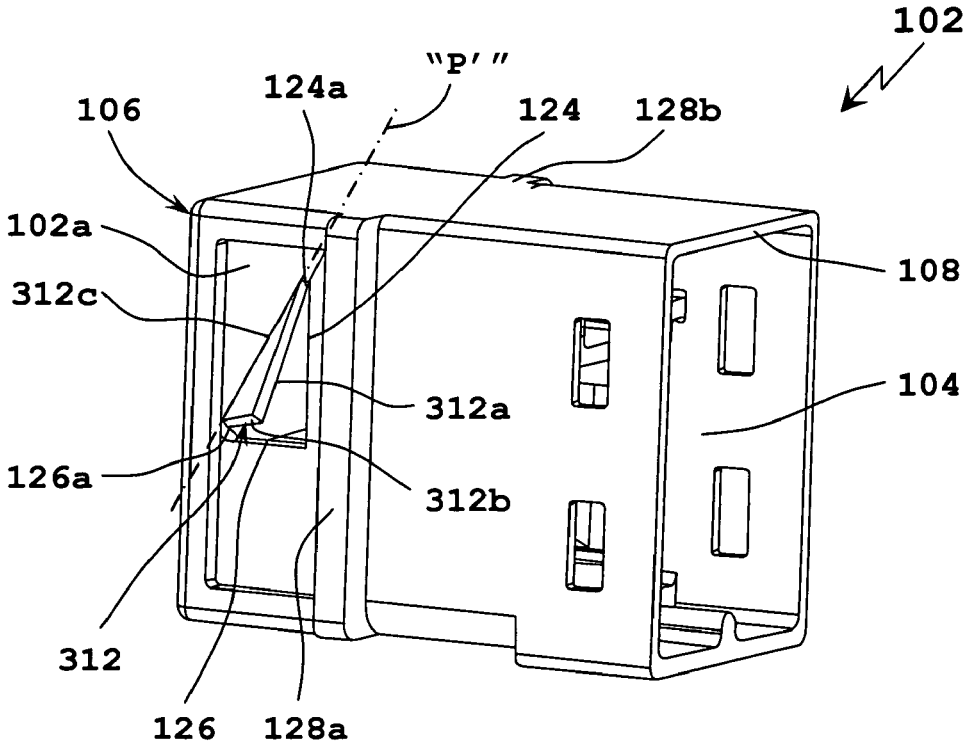
FIG. 9 is a top, rear perspective view of the connector receptacle housing of FIG. 8.

Turning now to FIGS. 8 and 9, a modular jack housing according to another embodiment of the present disclosure is shown and described. The modular jack housing of FIGS. 8 and 9 is substantially similar to modular jack housing 102 described hereinabove and thus will only be discussed in detail herein to the extent necessary to identify differences in construction and/or operation.

As illustrated in FIGS. 8 and 9, modular jack housing 102A includes a pair of flexible latch members 312 disposed on outer surfaces 102*a*, 102*b* of housing 102A. Each latch member 312 is a flap or tab which projects from the outer surfaces 102*a*, 102*b* of housing 102A. Each latch member 312 is generally triangular in shape and includes a first leg portion 312*a* spaced a distance from mating end 106 and oriented substantially parallel thereto; a second leg portion 312*b* extending substantially orthogonal to first leg portion 312*a*; and a third leg portion 312*c* interconnecting first and second leg portions 312*a*, 312*b*, respectively. Third leg portion 312*c* defines pivot axis "P' " of latch members 312. When latch member 312 is in an un-biased condition, first and second leg portions 312*a*, 312*b* extend outwardly from outer surface 102*a* and/or 102*b* of housing 102. Each latch member 312 is deflectable/pivotable, along pivot axis "P", such that first and second leg portions 312*a*, 312*b* are biased to lay flush with the outer surface 102*a* and/or 102*b* of housing 102.

Latch members 112, 114, 312 may be constructed from materials such as elastic, plastic, hybrid (combination of elastic and plastic), and other materials suitable for enabling the latch members 112, 114, 312 to function in accordance with the teachings of the present disclosure.

It will be understood that numerous modifications and changes in form and detail may be made to the embodiments of the present disclosure. It is contemplated that numerous other configuration of the modular jack housing 102 may be used, and the material of the modular jack housing 102 and latch members 112, 114, 312 may be selected from numerous materials other than those specifically disclosed. Therefore, the above description should not be construed as limiting the disclosed modular jack assembly but merely as exemplifications of the various embodiments thereof.

Those skilled in the art will envision numerous modifications within the scope of the present disclosure as defined by the claims appended hereto. In short, it is the Applicant's intention that the scope of the patent issuing herefrom will be limited only by the scope of the appended claims. Having thus described the invention with the details and particularity required by the patent laws, what is claimed and desired protected is set forth in the appended claims.

What is claimed is:

1. A connector receptacle assembly comprising:

a housing having an outer surface and a mating end for connecting to a plug assembly, the outer surface having a longitudinally extending slot and a transversely extending slot formed therein, wherein the slots are joined to one another; and at least one flexible latch member disposed on and projecting from the outer surface of the housing, wherein each latch member includes only two surfaces unattached from the outer surface, a first surface extending along the longitudinally extending slot and a second surface extending along the transversely extending slot.

2. The connector receptacle assembly as recited in claim 1, wherein the longitudinally extending slot extends along a side edge of the latch member and the transversely extending slot extends along a rear edge of the latch member.

3. The connector receptacle assembly as recited in claim 1, wherein the longitudinal and transverse slots define an L-shaped slot extending about a pair of sides of the at least one flexible latch member.

4. The connector receptacle assembly as recited in claim 1, wherein the at least one flexible latch member includes a rear surface and a front angled surface extending rearwardly from the mating end of the housing.

5. The connector receptacle assembly as recited in claim 1, further comprising at least one stop member outwardly extending from a surface of the housing and located rearward of the at least one flexible latch member.

6. The connector receptacle assembly as recited in claim 1, wherein each latch member is pivotable about a pivot axis extending between a distal end of the longitudinal slot and a distal end of the transverse slot.

7. The connector receptacle assembly as recited in claim 6, wherein the at least one flexible latch member is adapted for relative pivotable movement about the pivot axis from a first un-biased position to a second biased position.

8. The connector receptacle assembly as recited in claim 7, wherein the at least one flexible latch member protrudes from the surface of the housing when in the first un-biased position.

9. The connector receptacle assembly as recited in claim 7, wherein in the second biased position, the at least one flexible latch member pivots towards a central cavity of the housing.

10. A connector receptacle housing defining a cavity for receiving a plug assembly therein, the housing comprising:

a first outer surface;

at least one latch member disposed on the first outer surface of the housing and having only two surfaces unattached from the outer surface, the at least one latch member including:

a rear surface; and a forward angled surface extending away from a front surface of the housing; and a pair of orthogonally oriented slots formed in the first outer surface of the housing, wherein each slot extends between opposed ends defined by the first outer surface, and wherein each slot is located along a respective side of the latch member;

wherein the latch member is deflectable into the cavity of the housing.

11. The housing as recited in claim 10, wherein the at least one latch member is integrally formed with the housing.

12. The housing as recited in claim 10, further comprising at least one elongated stop member outwardly extending from a surface of the housing.

13. The housing as recited in claim 10, wherein the pair of orthogonally oriented slots define an L-shaped slot extending about a pair of sides of the at least one latch member.

14. The housing as recited in claim 10, wherein the at least one latch member is deflectable between a first un-biased position to a second biased position.

15. The housing as recited in claim 14, wherein in the second biased position the at least one latch member is deflected towards the cavity of the housing.

16. The housing as recited in claim 14, wherein the at least one latch member protrudes from the first outer surface of the housing when in the first un-biased position.

17. The housing as recited in claim 14, wherein the at least one latch member is configured to be biased toward the second biased position.

18. A modular jack assembly comprising:

a housing defining a cavity for receiving a modular plug assembly therein;

a plurality of wires within the cavity for providing electrical communication with the modular plug assembly received therein;

at least one latch member supported on and projecting from an outer surface of the housing and having only two surfaces unattached from the outer surface; and a pair of orthogonally extending slots formed in the outer surface of the housing, wherein the pair of orthogonally extending slots are located adjacent the at least one latch member, and wherein a pivot axis for the at least one latch member is defined between distal ends of the pair of orthogonally extending slots.

19. The modular jack assembly as recited in claim 18, wherein the at least one latch member is deflectable from a first un-biased position to a second biased position.

20. The modular jack assembly as recited in claim 19, wherein the at least one latch member is adapted for pivotable movement about the pivot axis when deflected between the first un-biased position to the second biased position.

* * * * *